US006785991B2

(12) United States Patent
Colip

(10) Patent No.: US 6,785,991 B2
(45) Date of Patent: Sep. 7, 2004

(54) COLLAPSIBLE TRAFFIC CONTROL SIGN

(76) Inventor: Timothy C. Colip, 343 Windswept Rd., Greenfield, IN (US) 46140

( * ) Notice: Subject to any disclaimer, the term of this patent is extended or adjusted under 35 U.S.C. 154(b) by 89 days.

(21) Appl. No.: 10/125,018

(22) Filed: Apr. 18, 2002

(65) Prior Publication Data

US 2003/0196360 A1 Oct. 23, 2003

(51) Int. Cl.[7] ..... G09F 13/16

(52) U.S. Cl. ..... 40/582; 40/606.15; 40/610; 40/612

(58) Field of Search ..... 40/582, 592, 606.15, 40/610, 612, 591; 362/812

(56) References Cited

U.S. PATENT DOCUMENTS

| | | | | | |
|---|---|---|---|---|---|
| 2,836,914 | A | | 6/1958 | Nelson et al. | 40/129 |
| 3,375,365 | A | | 3/1968 | Gross | 240/7.1 |
| 3,479,641 | A | | 11/1969 | Summers | 340/109 |
| 3,579,184 | A | | 5/1971 | Forestal | 340/137 |
| 3,622,980 | A | | 11/1971 | Elledge, Jr. | 340/82 |
| 3,933,119 | A | * | 1/1976 | Hedgewick et al. | 40/612 |
| 3,936,967 | A | | 2/1976 | Davis | 40/129 |
| 4,081,788 | A | | 3/1978 | Gaspar | 340/137 |
| 4,087,785 | A | | 5/1978 | Dodich | 340/114 |
| 4,152,854 | A | * | 5/1979 | Berry et al. | 40/610 |
| 4,197,808 | A | | 4/1980 | Kinninger | 116/63 |
| 4,259,660 | A | | 3/1981 | Oliver | 340/120 |
| 4,531,472 | A | * | 7/1985 | Marrero et al. | 40/612 |
| 4,593,265 | A | | 6/1986 | McKenney | 340/114 |
| 4,607,444 | A | | 8/1986 | Foster | 40/550 |
| 4,759,606 | A | * | 7/1988 | McDowell | 359/553 |
| 5,103,205 | A | | 4/1992 | Halligan | 340/473 |
| D354,991 | S | | 1/1995 | DeSutter | D20/42 |
| 5,572,188 | A | * | 11/1996 | McDowell, II | 40/610 |
| 5,775,253 | A | * | 7/1998 | Quan et al. | 40/612 |
| 5,970,639 | A | * | 10/1999 | Hui | 40/610 |
| 6,138,394 | A | | 10/2000 | Sulenski | 40/591 |
| 6,389,721 | B1 | * | 5/2002 | Yang | 40/610 |

* cited by examiner

*Primary Examiner*—Gary Hoge
(74) *Attorney, Agent, or Firm*—Woodard, Emhardt, Moriarty, McNett & Henry LLP

(57) ABSTRACT

A collapsible traffic control sign in the form of an arrow board for providing an alert warning to approaching traffic includes a collapsible frame including first, second and third frame members and four cooperating link members. Each link member is connected at opposite ends with a pivotal connection to a different one of the frame members. In a closed condition, the traffic control sign orients each of the three frame members in a substantially parallel and contiguous arrangement. When opened, the frame members are spaced apart and extending between each pair of frame members are two link members. The link members are oriented such that each pair creates the shape of a pointed arrow. Three light subassemblies are assembled to each of the four link members and the lights are illuminated by battery power from a vehicle by means of a cigarette lighter adapter.

30 Claims, 7 Drawing Sheets

COLLAPSIBLE TRAFFIC CONTROL SIGN

BACKGROUND OF THE INVENTION

The present invention relates in general to traffic controlling and directing devices for helping to manage and direct the flow of traffic past some point. More specifically, the present invention relates to an arrow board or similar informational sign which includes, in one embodiment, lighting units that are illuminated to advise approaching motorists and/or pedestrians of some situation, lane restriction, or merge direction. In a related embodiment, the lighting units are replaced by reflective material panels. The term "traffic" as used herein is intended to include motorists, cyclists, and/or pedestrians, depending on the circumstances.

We are all familiar with construction signs and warning (or control) devices which are set up at road construction sites. Sometimes the control devices are nothing more than orange cones or pylons which gradually shut down a lane and funnel the approaching traffic into one or more fewer (other) lanes. Sometimes these control devices might be used to create a "barricade" around a vehicle that is being repaired or is stopped for some other reason. While these types of devices serve a purpose, they are not all that visible until the motorist is almost at the site, and thus not really suitable for higher speed traffic. The volume of approaching traffic is also a consideration, factoring into the reduction of lanes the number of vehicles and how much advanced warning, in terms of distance, is needed. There are also situations where it may be necessary to direct a large number of pedestrians, such as at special events, concerts, and sporting venues.

When there is a scheduled construction site on a state or federal highway, there is likely ample time to bring to that site suitable warning or alert devices, such as "arrow boards". As that phrase is used herein, it pertains to the larger signs arranged with a pattern of lights which have the shape of an arrow. These lights are illuminated and may include lighting control circuitry in order to sequence the lights so that the arrow appears to move to the left or to the right, depending on the lane or lanes that are closed and which way the approaching traffic needs to merge.

Typically, these arrow boards are large, bulky devices which have to be trucked or towed to the construction site. Still, since the planned construction or repair work on the highway or bridge or overpass, for example, can be prescheduled, there is ample time to bring in the necessary arrow boards. What then can be done if a highway situation occurs, such as an accident or breakdown, and an arrow board is desired at that location? Similar unplanned events would include temporary utility work. These events are obviously "emergency" matters that are not planned and cannot be scheduled in advance. Typically, all that can be done is for law enforcement personnel who arrive at the scene to put out flares and try to warn motorists and try to block the affected lane or lanes of the highway. One problem with this approach is that flares which are placed on the highway surface may not be that visible from a distance, especially with high and low points in the highway. Further, flares do not give any directional information as to which way the traffic needs to merge. The issue of visibility affects the suitability of flares to provide an adequate lead time for the traffic to make a smooth merge from the blocked lane to the other lane or lanes which are open.

Regarding the need to direct a large number of pedestrians, it is conceivable that entry (or exit) gates might be closed or obstructed and thus a need to alert the pedestrians to this fact. The noise level usually prevents giving oral instructions, but a quickly set up arrow board, placed on the top of a vehicle, for example, could be the answer.

In order to improve on this situation of needing (or preferring) an arrow board device on an "emergency" basis for motorists, cyclists, and/or pedestrians, the present invention was conceived. What is disclosed is a collapsible traffic control sign which is portable and can be easily carried in the trunk of a car or vehicle. In the preferred embodiment of the present invention, this collapsible traffic control sign is configured as an arrow board with a series of lights which are illuminated by the use of vehicle battery power by way of a cigarette lighter adapter. In an alternate embodiment of the present invention, the illuminated lights are replaced with reflective material panels. Whenever and wherever an arrow board is needed, the present invention can be quickly pulled out, opened and extended, plugged into a power source (unless using the reflective material panels), and begin use. The disclosed arrow board (traffic control sign) according to the present invention can be flipped top-to-bottom in order to change the direction the arrows are pointing.

SUMMARY OF THE INVENTION

A collapsible traffic control sign for providing an alert warning to approaching traffic according to one embodiment of the present invention comprises a collapsible frame including first, second and third frame members and a pair of cooperating link members. A first link member is pivotally connected at a first end to the first frame member and is pivotally connected at a second end to a second frame member. A second link member is pivotally connected at a first end to a third frame member and is pivotally connected at a second end to the second frame member. Included as part of the collapsible traffic control sign is a plurality of lights which are assembled onto the first and second link members and the lights are illuminated by power from the vehicle battery by means of a cigarette lighter adapter. In a related embodiment of the present invention, the plurality of lights are replaced by reflective material panels.

One object of the present invention is to provide an improved collapsible traffic control sign.

Related objects and advantages of the present invention will be apparent from the following description.

DESCRIPTION OF THE PREFERRED EMBODIMENTS

Figure 1:
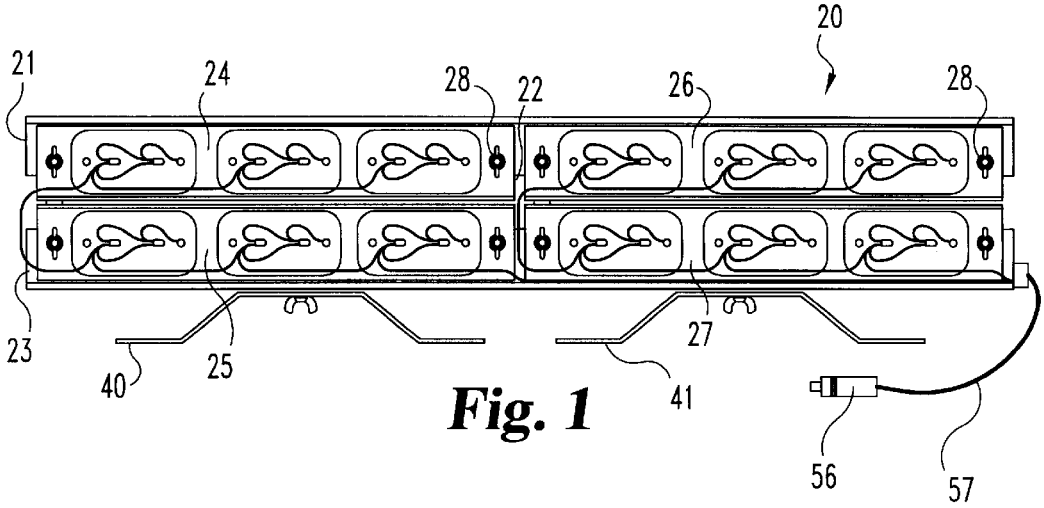
FIG. 1 is a front elevational view of a collapsible traffic control sign in a collapsed or closed condition according to a typical embodiment of the present invention.
Figure 4:
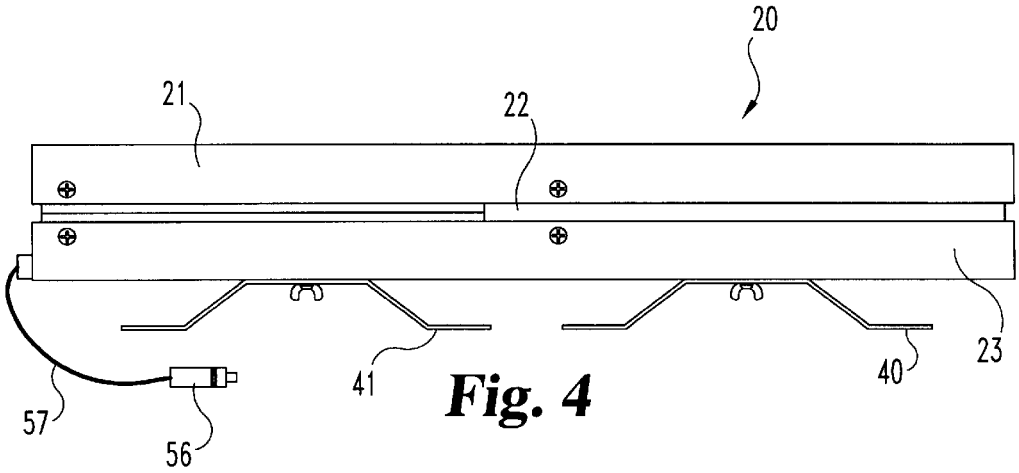
FIG. 4 is a rear elevational view of the FIG. 1 collapsible traffic control sign.
Figure 2:
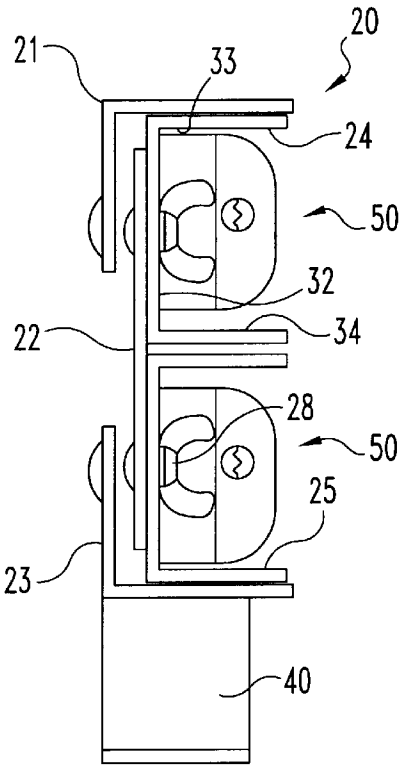
FIG. 2 is an enlarged, side elevational view of the FIG. 1 collapsible traffic control sign.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 11:
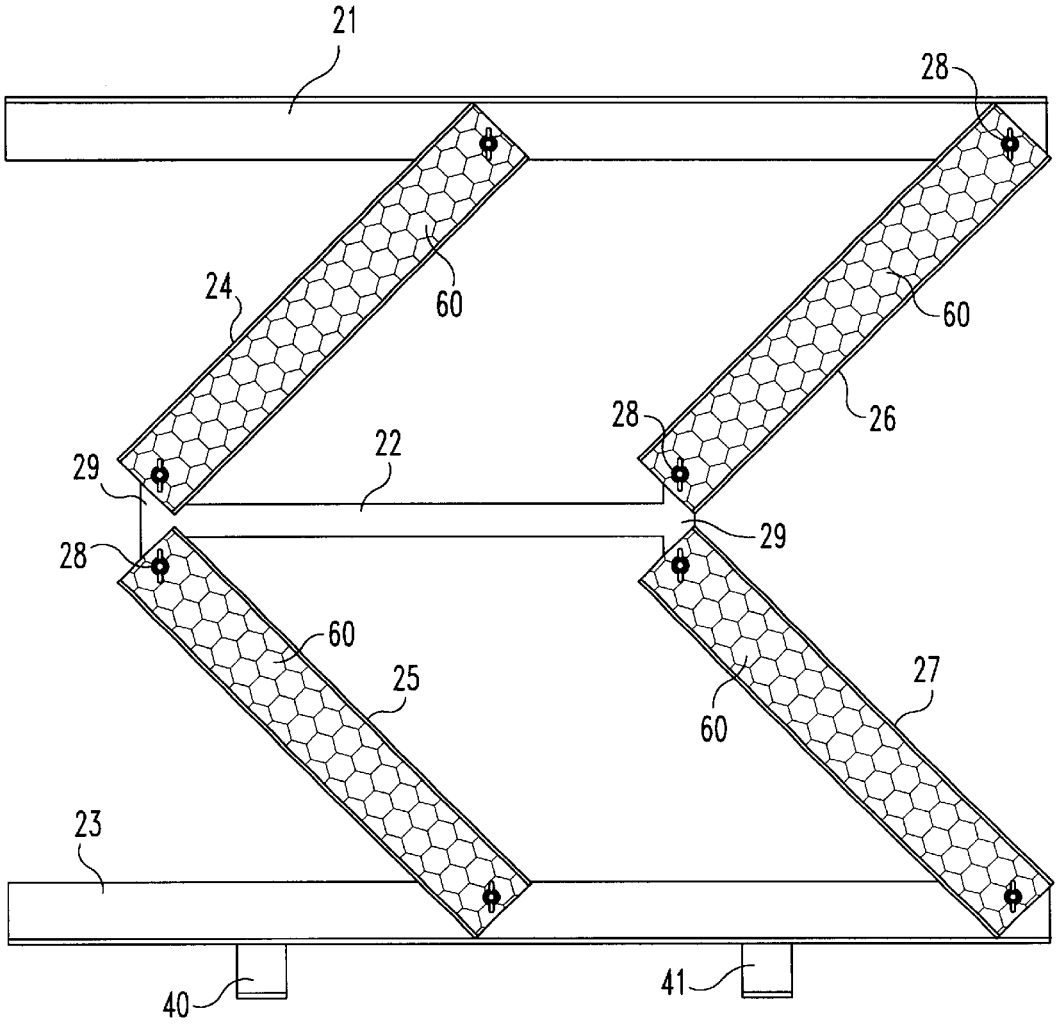
FIG. 11 is a front elevational view of a collapsible traffic control sign in the extended or open condition according to another embodiment of the present invention.

Referring to FIGS. 1–10, there is illustrated a collapsible traffic control sign 20 according to a first embodiment of the present invention. In FIG. 11 an alternate embodiment of the present invention is disclosed wherein the light subassemblies of the first embodiment are replaced by panels of reflective material. For the most part, other than this change, the first and second embodiments of the present invention are virtually identical.

As outlined in the Background discussion and with continued reference to FIGS. 1–10, traffic control sign 20 is constructed and arranged to be used to direct and control traffic (motorists, cyclists, and/or pedestrians) which is approaching a situation on a roadway or other venue. The anticipated situation which would give rise to the use of traffic control sign 20 would include an accident, utility work, construction which could be directed to an overpass, the highway surface, or a bridge, at a special event or a sporting event venue, to name a few examples. Further, the anticipated situation is one which requires the traffic to move from one lane to another or to merge in a particular direction.

Figure 3:
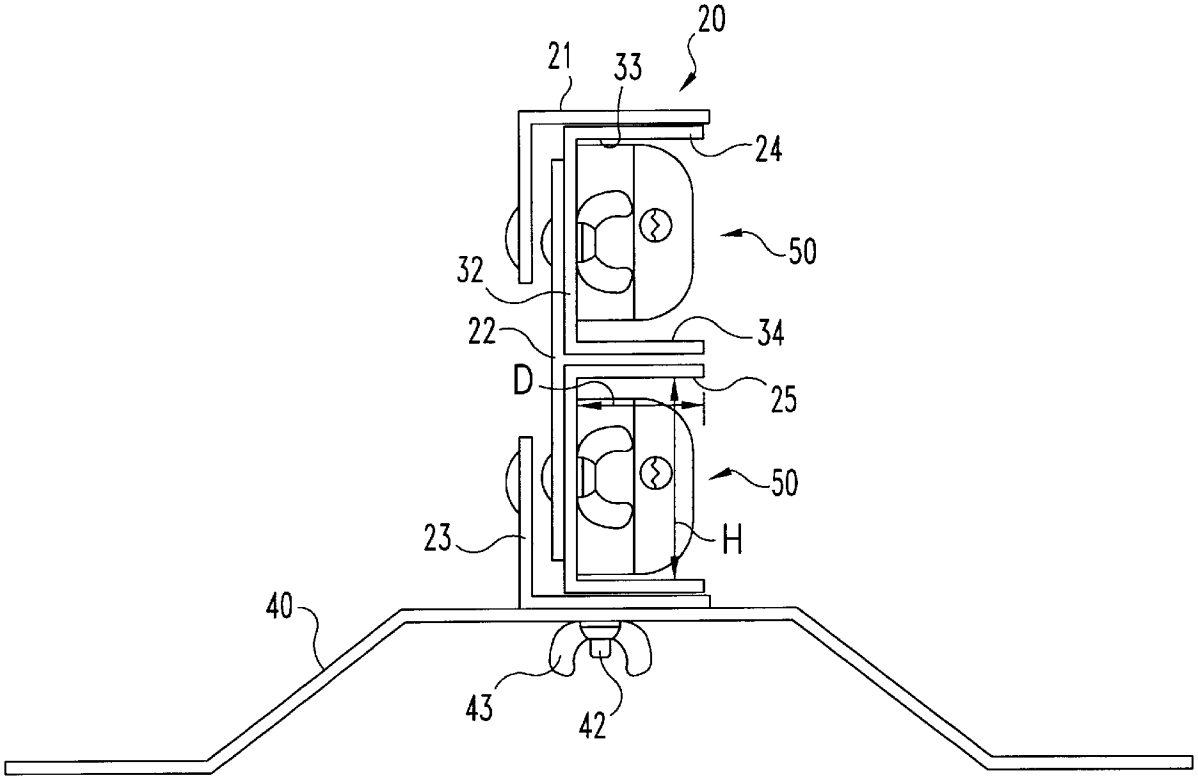
FIG. 3 is an enlarged, side elevational view of the FIG. 1 collapsible traffic control sign with its support brackets turned ninety degrees from the FIG. 2 orientation.
Figure 5:
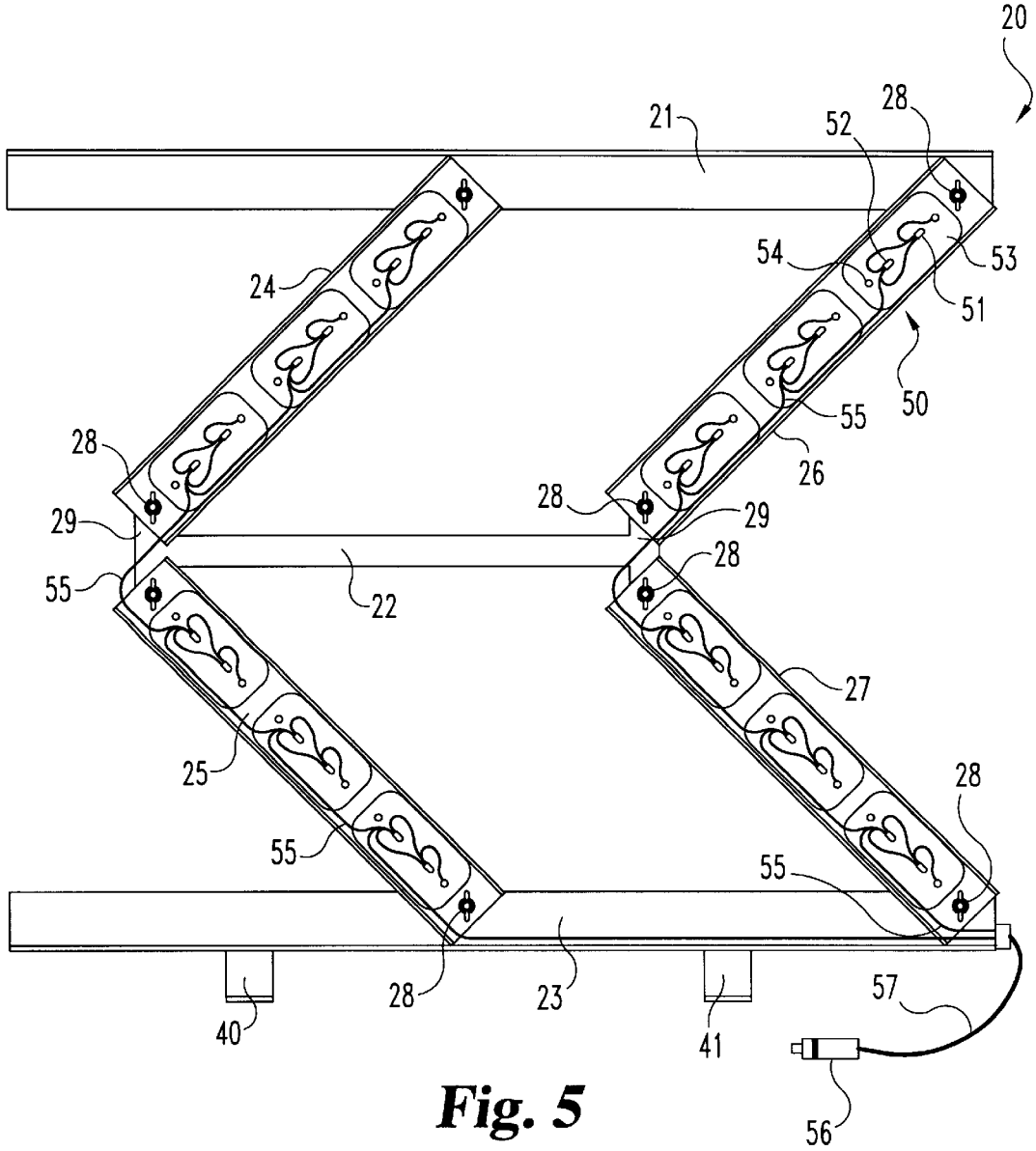
FIG. 5 is a front elevational view of the FIG. 1 collapsible traffic control sign in an extended or opened condition according to the present invention.
Figure 6:
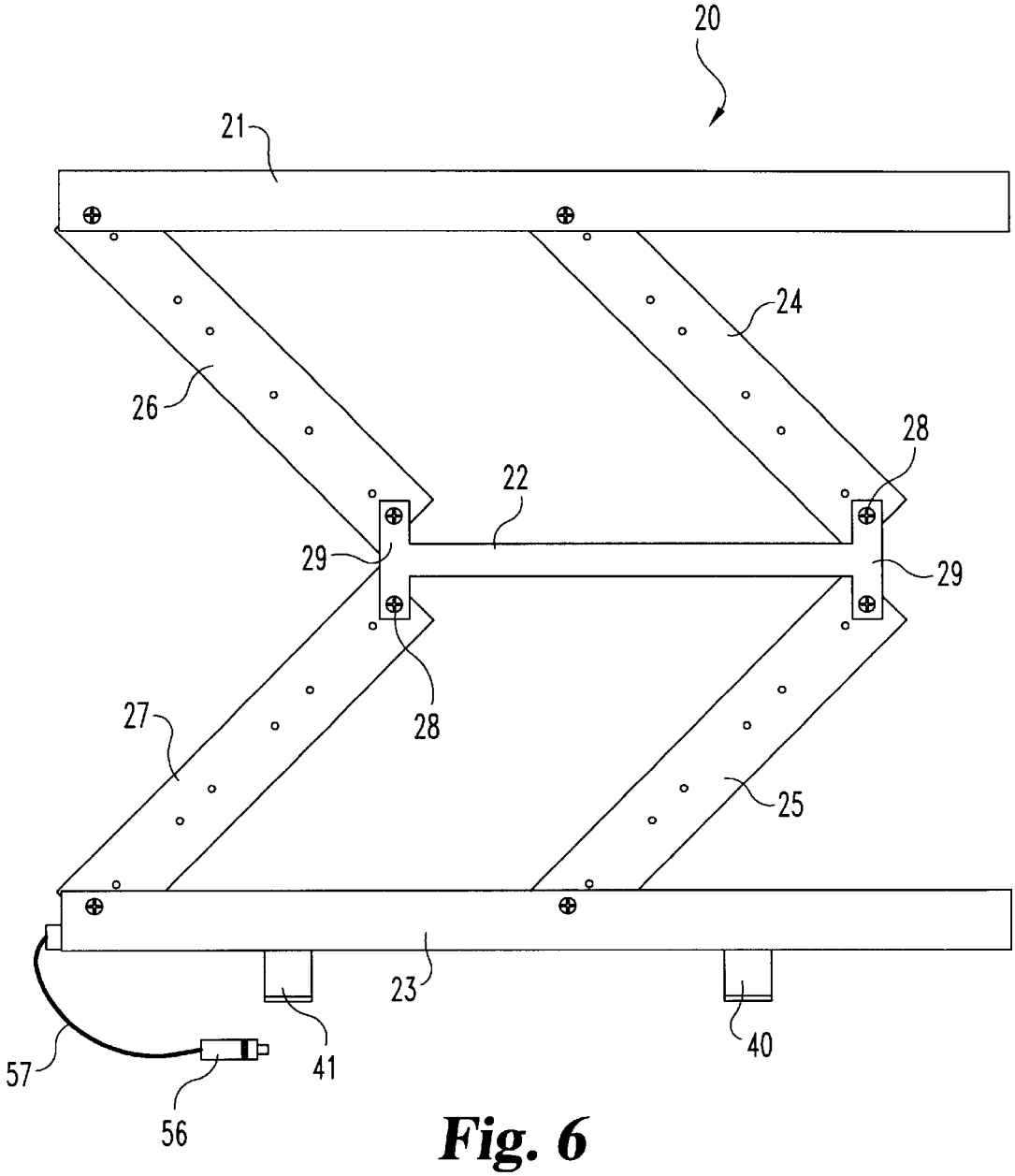
FIG. 6 is a rear elevational view of the FIG. 5 collapsible traffic control sign.
Figure 7:
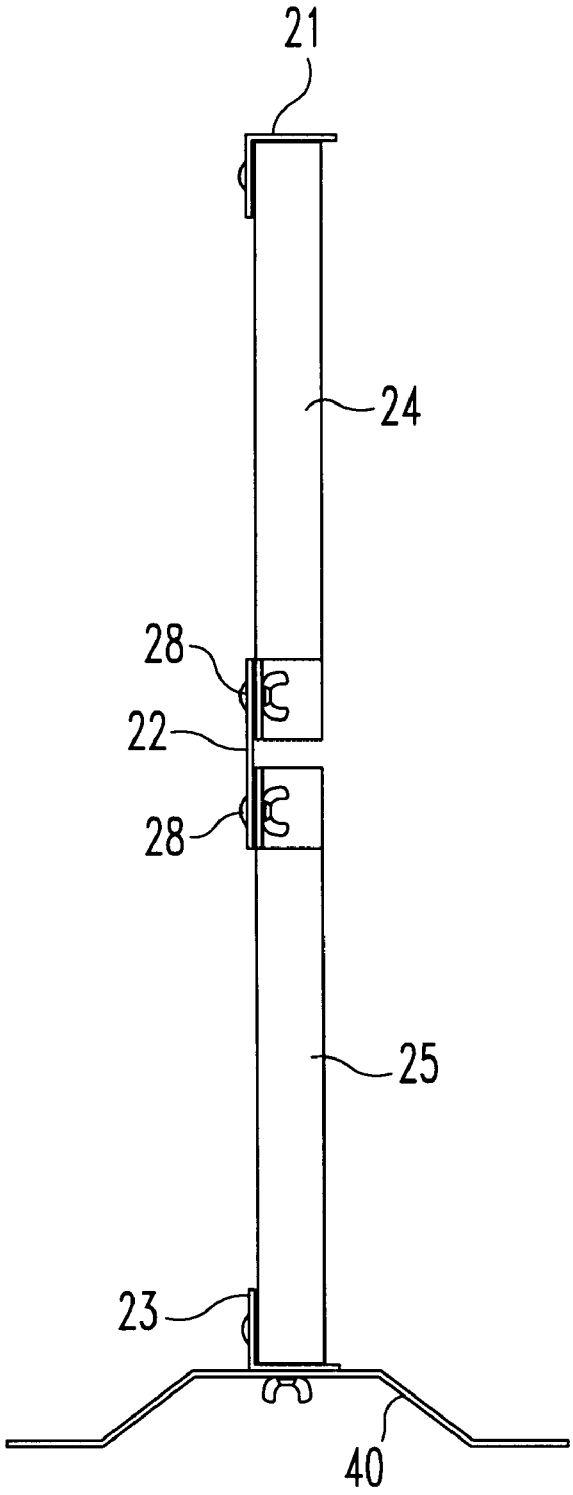
FIG. 7 is a side elevational view of the FIG. 5 collapsible traffic control sign.
Figure 8:
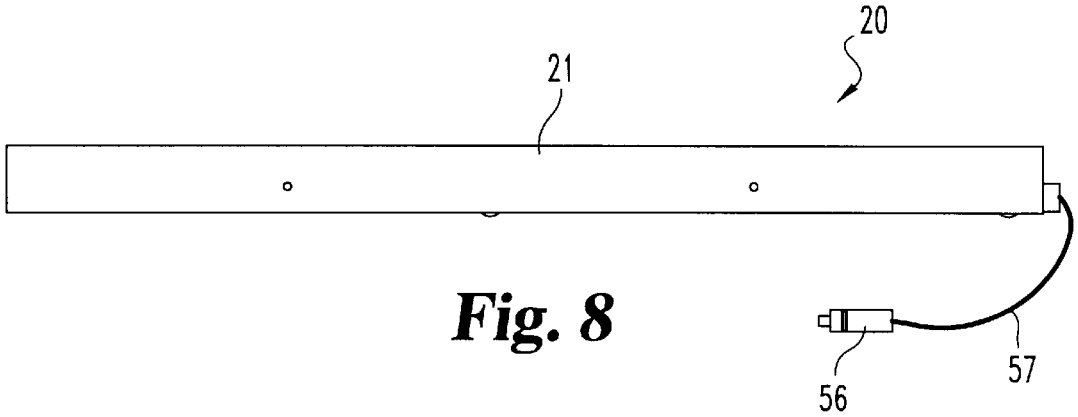
FIG. 8 is a top plan view of the FIG. 1 collapsible traffic control sign.
Figure 9:
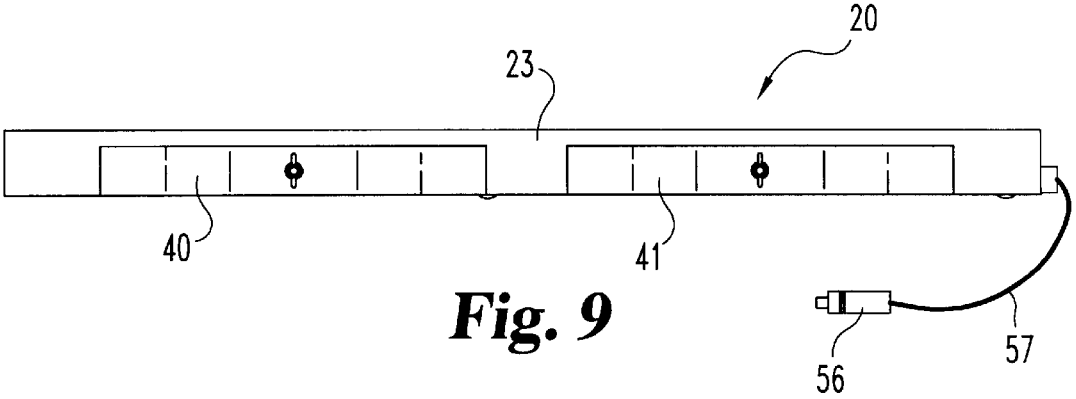
FIG. 9 is a bottom plan view of the FIG. 1 collapsible traffic control sign.
Figure 10:
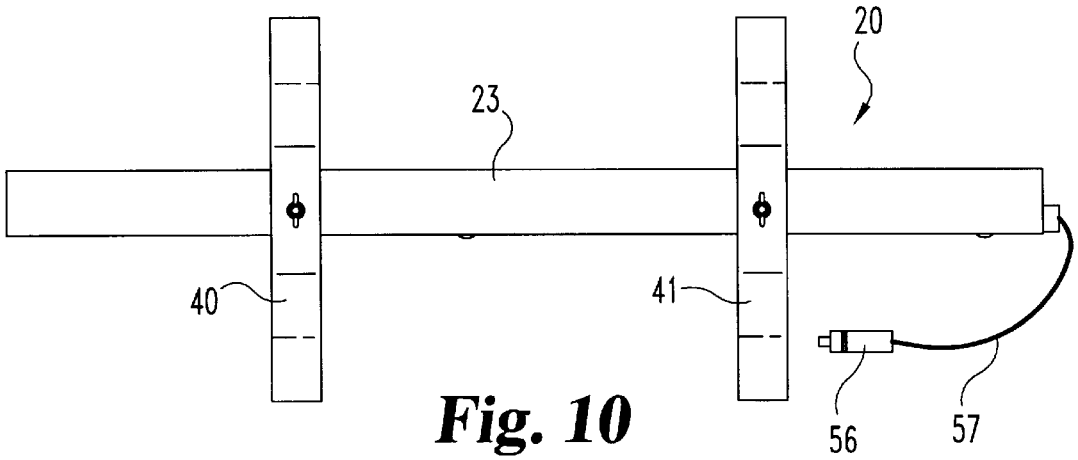
FIG. 10 is a bottom plan view of the FIG. 3 collapsible traffic control sign.

The disclosed traffic control sign 20 includes an arrangement of three frame members 21, 22, and 23 and four link members 24, 25, 26, and 27 which are pinned together by pivoting connections 28 (see FIG. 5). The manner of pivotally connecting the four link members at their opposite ends to adjacent pairs of frame members allows the traffic control sign 20 to be manually configured into a folded or closed condition wherein the three frame members and the four link members collapse into the form illustrated in FIGS. 1–4. In this collapsed condition, the three frame members 21, 22 and 23 are contiguous to each other, 21, to 22 and 22 to 23, and substantially parallel. The four link members 24, 25, 26, and 27 are also substantially parallel to each other and to the frame members in this collapsed condition. At this point it should be noted that while FIG. 3 illustrates the traffic control sign 20 in a collapsed or closed condition, the difference between FIG. 3 and the remaining illustrations of FIGS. 1, 2, and 4 relates solely to the support bracket-like legs which are turned ninety degrees in the FIG. 3 illustration and this particular feature will be described in greater detail hereinafter.

In the collapsed condition of FIGS. 1–4, the overall size and weight of the traffic control sign 20 is such that it is readily portable and can be easily transported in the trunk of a car or storage bay of a sport utility vehicle. In the configuration illustrated, frame members 21 and 23 are each preferably sheet metal, L-shaped angles that are straight lengths measuring approximately 32 inches in length and 1.75 inches on a side (i.e., each leg of the L-shape). Frame member 22 is a flat length of sheet metal measuring approximately 17.5 inches in length and including T-shaped portions 29 at each end. While sheet metal construction is preferred for the frame members 21, 22, and 23 and for the four link members 24–27, it is also contemplated that a molded plastic construction can be used for each of these seven component pieces. The use of plastic assumes that the plastic material selected will have the necessary strength and durability and will be suitably weather resistant so as to provide a suitable and compatible material for the particular application. One anticipated advantage of plastic is a lower overall weight which would contribute to the portability of the traffic control sign 20.

Still referring to FIGS. 1–10, each of the four link members 24–27 are configured of sheet metal channels with a rear base panel 32 and a pair of oppositely disposed, forward-facing upper and lower panels 33 and 34, respectively. Each link member measures approximately 15.5 inches in length and each of the upper and lower panels 33 and 34 measures approximately 1.25 inches in front to rear length or depth. The rear base panel 32 establishes the spacing between the upper panel 33 and the lower panel 34 such that the open space in the interior of the open channel of each link member is approximately 2.14 inches in height (H) and is approximately 1.25 inches in front to rear depth (D).

With continued reference to FIG. 5, the traffic control sign 20 is illustrated in an opened (uncollapsed) condition showing the specific points of connection between frame members 21, 22, and 23 and the link members 24, 25, 26, and 27 using pivoting connections 28. As illustrated, link member 24 is pivotally connected at one end to a mid-region of frame member 21 and at an opposite end to an upper section of a first T-shaped portion 29 of frame member 22. Link member 26 is pivotally connected at one end to one end of frame member 21 and at an opposite end to an upper section of a second T-shaped portion 29 of frame member 22. Link member 25 is pivotally connected at one end to a mid-region of frame member 23 and at an opposite end to a lower section of the first T-shaped portion 29. Link member 27 is pivotally connected at one end to one end of frame member 21 and at an opposite end to a lower section of the second T-shaped portion 29. In the opened condition of FIG. 5, frame members 21–23 are parallel to each other. Link members 24 and 25 are converging toward frame member 22 as are link members 26 and 27. Additionally, all four link members are oriented at an angle or inclined relative to the frame members. Link members 24 and 26 each define an acute included angle with frame member 21. Link members 25 and 27 each define an acute included angle with frame member 23.

Traffic control sign 20 can be viewed as having a symmetrical configuration about the longitudinal centerline of frame member 22. In effect, if the traffic control sign 20 is "folded" top to bottom about the longitudinal centerline of frame member 22, the frame members and link members all line up as if the top half of the traffic control sign is superimposed on the bottom half of traffic control sign 20. Since link members 24 and 25 are both pivotally connected to the first T-shaped portion, they form the appearance of an "arrow" pointing to the left in FIG. 5. Similarly, link members 26 and 27 both pivotally connect to the second T-shaped portion and they form the appearance of a second "arrow" also pointing to the left in FIG. 5. These two "arrows" are virtually identical to each other as to their size, shape, and orientation in the FIG. 5 illustration. The only actual difference is their left-to-right spacing.

Each pivoting connection 28, which joins together the frame members 21, 22, and 23 with their corresponding link members 24, 25, 26, and 27, includes an externally-threaded bolt and a mating wing nut. Each bolt extends through the two corresponding members being pivotally connected, including at each location one frame member and one link member. The use of cooperating flat washers is optional, depending on the size of the clearance holes in the two members being connected. The use of wing nuts allows each pivoting connection 28 to be manually loosened and manually tightened. When the traffic control sign 20 is in the collapsed condition of FIG. 1, the wing nuts can be tightened in order to secure the traffic control sign 20 in its collapsed condition for ease in handling and removal from its storage or transporting location. Once positioned at the use location, the wing nuts (if tightened) are loosened and the traffic control sign 20 is extended into its FIG. 5 orientation. At this point, the wing nuts are tightened to secure the traffic control sign 20 in its extended or opened condition of FIG. 5. In this regard, it should be understood that the concept of the wing nuts being "loose" or "tight" are both relative terms. In fact, it is contemplated that the wing nuts will be tightened to the point that they are simply "snug" so that forcefully pulling the top frame member 21 and the bottom frame member 23 apart extends the traffic control sign 20 into the FIG. 5 (open) operating condition by the pivoting of the link members. Once in this condition, the nominal weight of the traffic control sign 20, if the wing nuts are snug, is not sufficient to collapse the traffic control sign 20 without some degree of manual assistance. With the traffic control sign in the FIG. 5 orientation, the wing nuts can be tightened to more securely fix the traffic control sign in this opened condition.

The traffic control sign 20 can be placed on virtually any support surface so long as the surface is relatively even and generally horizontal, such as the hood, top, or trunk lid of a vehicle. The traffic control sign can also be placed directly on the road surface or shoulder, but it is felt that a more elevated or higher support surface location is preferable so as to give the approaching motorists a better view. Further, while it is possible to position the lower frame member 23 directly on the selected support surface, the traffic control sign 20 includes a pair of support brackets 40 and 41, each of which is a metal frame footed member which is attached to the lower surface of frame member 23. The width or thickness of frame member 23 is sufficient to provide the needed stability for the traffic control sign 20 to remain upright. However, the addition of the two support brackets 40 and 41, when they are turned ninety degrees to the remainder of the traffic control sign 20, as now illustrated in FIG. 3, provides added stability and helps to accommodate minor unevenness in the selected support surface. The bottom surface of each support bracket 40 and 41 is provided with a synthetic pad to avoid scratching the support surface.

The hardware used to attach each support bracket 40 and 41 includes an externally-threaded bolt 42 and a mating wing nut 43. By manually loosening and tightening the wing nuts 43, the two support bracket 40 and 41 can be turned between a stowed orientation of FIGS. 1, 2, and 4 and the support orientation of FIGS. 3, 5, and 6, for example.

The two "arrows" which are created by the angled or inclined orientation of the four link members 24–27 when the traffic control sign 20 is opened and extended into the FIG. 5 orientation both point in the same direction. In FIG. 5 this direction is to the left when facing the "front" of the traffic control sign 20 which is the view of FIG. 5. In order to change the direction of the linked member arrows from pointing left to pointing right, the traffic control sign 20 is simply turned top-to-bottom, or in essence flipped over, so that the upper surface 21*a* of frame member 21 becomes the lower surface and frame member 21 becomes a supporting frame member. In order to retain the benefit of the two support brackets 40 and 41, mounting holes are included in frame member 21 so that the two support brackets 40 and 41 can be moved from frame member 23 to frame member 21 when the arrows need to point to the right. Alternatively, a second pair of support brackets can be added to frame member 21 so that regardless of which way the arrows are to point, the support brackets are already mounted to the corresponding frame member. The ability to stow the support brackets when not in use facilitates the more compact and streamlined appearance of the traffic control sign 20. Consequently, it is seen as a time advantage to include two sets of support brackets so that the direction of the arrows can be quickly established by simply loosening two wing nuts and turning the selected support brackets ninety degrees to the remainder of the traffic control sign and then placing the sign on the desired support surface. There is no loss of time in having to take off two support brackets from one frame member and move them to the other. The only item which is sacrificed in having a second set of support brackets is the added cost and added weight.

In order to cause the two arrows which are created by the four link members 24–27 to be more visible, it is preferred to include some type of reflective or illumination or lighting feature. In the preferred embodiment of FIGS. 1–10, the lighting or illumination feature is provided by a series of lamp subassemblies 50 which are wired in parallel so that burn out or shorting of one lamp subassembly 50 does not affect any of the other lamp subassemblies 50.

Each light subassembly 50 includes a pair of replaceable lamps 51 and a cooperating (dual) receiving socket 52 positioned within a plastic base 53 with an amber lens. Each subassembly 50 is attached to a corresponding link member 24–27 and is positioned within the open channel portion of the corresponding link member. A pair of mounting screws 54 are used to secure each light subassembly 50 to its link member. A clearance hole and nut may be used or the rear base panel may include an internally threaded hole for each mounting screw. Other lamp styles, including LEDs, may be used with the present invention so long as the illumination is bright enough to be seen at a distance.

The required wiring harness 55 for the parallel connection of the twelve light subassemblies 50, three in each link member, is illustrated and the wiring harness 55 includes a power connection plug 56 and a connecting power cord 57. The power connection plug 56 is constructed and arranged as a cigarette lighter adapter so that available vehicle power can be used to illuminate the lamps 51 of each light subassembly 50. Virtually any type of lamp 51 and socket 52 can be used so long as the size fits within the housing 53 and so long as the vehicle battery power is sufficient to generate enough illumination for the lamps to be visible at a distance such that the approaching traffic has enough time to slow down and merge into the open lanes. In the preferred embodiment, the light subassembly 50 is a VSM Model 9007 offered by VSM Co., Inc. of Newark, N.J.

It is also contemplated that part of the circuitry for the light subassemblies will include an electronic control module so as to sequence the lights in their on/off illumination mode. In this way, the individual lamps of the light subassemblies can be controlled in a flashing mode or in a sequential mode so as to make the illuminated arrows appear as if they are moving from the base of the arrow to the tip of the arrow.

As an alternative to the use of light subassemblies 50, FIG. 11 illustrates the use of a reflective material 60, a panel or strip of which is applied directly to each of the four link members 24–27. The U-shaped channel design of each link member 24–27 does not need to be retained if a reflective material panel or reflective material strips are used. The current style of link member, as illustrated in the first embodiment, could be replaced by a flat panel and thereby reduce the overall cost and weight of the traffic control sign 20. However, if the link members 24–27 are retained, it allows enhanced versatility in that either the light subassemblies 50 can be assembled to the link members or the reflective material 60 can be added as panels or strips directly to the link members. Otherwise, one style of traffic control sign with the light subassemblies is identical to the other style of traffic control sign with the reflective material panels.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A collapsible traffic control sign for providing an alert warning to approaching traffic, said traffic control sign comprising:

a collapsible frame including first, second, and third frame members and a pair of cooperating link members, a first link member being pivotally connected at a first end to said first frame member and being pivotally connected at a second end to said second frame member, a second link member being pivotally connected at a first end to said third frame member and being pivotally connected at a second end to said second frame member;

a plurality of lights disposed on said first and second link members;

illuminating means for delivering power to said plurality of lights; and wherein said collapsible frame is constructed and arranged to be moveable between a collapsed condition and an opened condition, such that in said collapsed condition said first and second frame members are substantially contiguous to each other and said second and third frame members are substantially contiguous to each other, in said open condition, said first, second and third frame members are spaced apart from each other.

2. The collapsible traffic control sign of claim 1 wherein with said frame in said collapsed condition, said first, second and third frame members are substantially parallel to each other.

3. The collapsible traffic control sign of claim 2 wherein with said frame in said open condition, said first, second and third frame members are substantially parallel to each other.

4. The collapsible traffic control sign of claim 3 wherein with said frame in said open condition, said first link member is oriented relative to said first frame member so as to define an acute included angle.

5. The collapsible traffic control sign of claim 4 wherein with said frame in said open condition, said second link member is oriented relative to said third frame member so as to define an acute included angle.

6. The collapsible traffic control sign of claim 5 wherein with said frame in said open condition, the second ends of said first and second link members are adjacent to each other.

7. The collapsible traffic control sign of claim 6 wherein said illuminating means includes an adapter for a vehicle cigarette lighter and a power cord connecting said adapter to said plurality of lights.

8. The collapsible traffic control sign of claim 7 wherein said plurality of lights are wired together in a parallel circuit.

9. The collapsible traffic control sign of claim 3 which further includes a third link member which is pivotally connected at a first end to said first frame member and at a second end to said second frame member.

10. The collapsible traffic control sign of claim 9 which further includes a fourth link member which is pivotally connected at a first end to said third frame member and at a second end to said second frame member.

11. The collapsible traffic control sign of claim 10 wherein with said frame in said open condition, said third link member is oriented relative to said first frame member so as to define an acute included angle.

12. The collapsible traffic control sign of claim 11 wherein with said frame in said open condition, said fourth link member is oriented relative to said third frame member so as to define an acute included angle.

13. The collapsible traffic control sign of claim 12 wherein with said frame in said open condition, the second ends of said third and fourth link members are adjacent to each other.

14. The collapsible traffic control sign of claim 13 wherein said illuminating means includes an adapter for a vehicle cigarette lighter and a power cord connecting said adapter to said plurality of lights.

15. The collapsible traffic control sign of claim 14 wherein said plurality of lights are wired together in a parallel circuit.

16. The collapsible traffic control sign of claim 1 wherein with said frame in said open condition, said first link member is oriented relative to said first frame member so as to define an acute included angle.

17. The collapsible traffic control sign of claim 16 wherein with said frame in said open condition, said second link member is oriented relative to said third frame member so as to define an acute included angle.

18. A collapsible traffic control sign for providing an alert warning to approaching traffic, said traffic control sign comprising:

a collapsible frame including first, second, and third frame members and a pair of cooperating link members, a first link member being pivotally connected at a first end to said first frame member and being pivotally connected at a second end to said second frame member, a second link member being pivotally connected at a first end to said third frame member and being pivotally connected at a second end to said second frame member;

a plurality of lights disposed on said first and second link members;

illuminating means for delivering power to said plurality of lights; and a third link member which is pivotally connected at a first end to said first frame member and at a second end to said second frame member.

19. The collapsible traffic control sign of claim 18 which further includes a fourth link member which is pivotally connected at a first end to said third frame member and at a second end to said second frame member.

20. The collapsible traffic control sign of claim 19 which further includes a fourth link member which is pivotally connected at a first end to said third frame member and at a second end to said second frame member.

21. The collapsible traffic control sign of claim 20 wherein with said frame in said open condition, said second link member is oriented relative to said third frame member so as to define an acute included angle.

22. A collapsible traffic control sign for providing an alert warning to approaching traffic, said traffic control sign comprising:

a collapsible frame including first, second, and third frame members and a pair of cooperating link members, a first link member being pivotally connected at a first end to said first frame member and being pivotally connected at a second end to said second frame member, a second link member being pivotally connected at a first end to said third frame member and being pivotally connected at a second end to said second frame member;

a plurality of reflective material panels disposed on said first and second link members; and wherein said collapsible frame is constructed and arranged to be moveable between a collapsed condition and an opened condition, such that in said collapsed condition said first and second frame members are substantially contiguous to each other and said second and third frame members are substantially contiguous to each other, in said open condition, said first, second and third frame members are spaced apart from each other.

23. The collapsible traffic control sign of claim 22 wherein with said frame in said collapsed condition, said first, second and third frame members are substantially parallel to each other.

24. The collapsible traffic control sign of claim 23 wherein with said frame in said open condition, said first, second and third frame members are substantially parallel to each other.

25. The collapsible traffic control sign of claim 24 wherein with said frame in said open condition, said first link member is oriented relative to said first frame member so as to define an acute included angle.

26. The collapsible traffic control sign of claim 25 wherein with said frame in said open condition, said second link member is oriented relative to said third frame member so as to define an acute included angle.

27. The collapsible traffic control sign of claim 26 wherein with said frame in said open condition, the second ends of said first and second link members are adjacent to each other.

28. A collapsible traffic control signal for providing an alert warning to approaching traffic, said traffic control signal comprising:

an elongated support member;

a first pair of link members constructed and arranged to form an arrow wherein each link member of said first pair is pivotally connected to said elongated support member at a first location;

a second pair of link members constructed and arranged to form an arrow wherein each link member of said second pair is pivotally connected to said elongated support member at a second location, wherein said first and second locations are spaced apart; and a plurality of lights assembled to said first and second pairs of link members.

29. A collapsible traffic control signal for providing an alert warning to approaching traffic, said traffic control signal comprising:

an elongated support member;

a first pair of link members constructed and arranged to form an arrow wherein each link member of said first pair is pivotally connected to said elongated support member at a first location;

a second pair of link members constructed and arranged to form an arrow wherein each link member of said second pair is pivotally connected to said elongated support member at a second location, wherein said first and second locations are spaced apart; and a plurality of reflective material panels disposed on said first and second pairs of link members.

30. A collapsible traffic control sign for providing an alert warning to approaching traffic, said traffic control sign comprising:

a collapsible frame including first, second, and third frame members and a pair of cooperating link members, a first link member being pivotally connected at a first end to said first frame member and being pivotally connected at a second end to said second frame member, a second link member being pivotally connected at a first end to said third frame member and being pivotally connected at a second end to said second frame member;

a plurality of reflective material panels disposed on said first and second link members; and a third link member which is pivotally connected at a first end to said first frame member and at a second end to said second frame member.

* * * * *